US006475004B2

(12) United States Patent
Shuey et al.

(10) Patent No.: US 6,475,004 B2
(45) Date of Patent: Nov. 5, 2002

(54) CONNECTOR ASSEMBLY WITH AN ENGAGEMENT ASSIST MEMBER AND CONNECTOR POSITION ASSURANCE DEVICE

(75) Inventors: John R. Shuey, Mechanicsburg, PA (US); Vincent M. Kane, Harrisburg, PA (US)

(73) Assignee: Tyco Electronics Corporation, Middleton, PA (US)

( * ) Notice: Subject to any disclaimer, the term of this patent is extended or adjusted under 35 U.S.C. 154(b) by 0 days.

(21) Appl. No.: 09/757,136

(22) Filed: Jan. 9, 2001

(65) Prior Publication Data

US 2002/0090849 A1 Jul. 11, 2002

(51) Int. Cl.[7] ..... H01R 13/62
(52) U.S. Cl. ..... 439/157
(58) Field of Search ..... 439/157, 347, 439/489, 752, 595, 701

(56) References Cited

U.S. PATENT DOCUMENTS 5,967,809 A * 10/1999 Fink et al. ..... 439/157

6,210,186 B1 * 4/2001 Fink et al. ..... 439/157

* cited by examiner

*Primary Examiner*—Renee Luebke
*Assistant Examiner*—Phuong Nguyen

(57) ABSTRACT

An electrical housing assembly is provided having a connector with an outer enclosure and a mating opening. The assembly further includes a header having a mating portion to engage the mating opening of the connector. A latch assist member is mounted to one of the header and connector and is movable between open and closed positions relative to the outer enclosure. The latch assist member includes passage ways receiving slide assist members that are mounted on the other of the header and connector. The passage ways and slide assist members cooperate to forcibly draw the header and connector into a fully mated position when the latch assist member moves to the closed position relative to the outer enclosure. A connector position assurance device (CPA) is slidably mounted to one of the connector and header and movable between locked and unlocked positions. The CPA secures the latch assist member in the closed position when the CPA is moved to its locked position.

22 Claims, 8 Drawing Sheets

CONNECTOR ASSEMBLY WITH AN ENGAGEMENT ASSIST MEMBER AND CONNECTOR POSITION ASSURANCE DEVICE

BACKGROUND OF THE INVENTION

The preferred embodiments of the present invention generally relate to a connector assembly with an engagement assist member that facilitates connection of a header and plug housing with one another while operating in combination with a connector position assurance device.

In the past, connector assemblies have been proposed having headers connectable to plug housings that are used to interconnect a plurality of male and female electrical contacts. In many applications, the header and plug may appear connected with one another, but yet in fact may not be fully engaged. Thus, features have been added to connectors that help to ensure that the header and plug housing (and thus the contacts) are fully engaged with one another. One feature added to connectors is a connector position assurance device (CPA) which has been combined with connector assemblies in a manner that requires the header and plug to be fully engaged before the CPA device may be moved to its closed position. CPAs enable visual inspection of a connector assembly to confirm that a header and plug are fully engaged with one another.

With improvements in technology and the miniaturization of components, header and plug combinations are being formed with an increasing larger number of contacts arranged in a relatively small cross-sectional area of the connector assembly. Male and female contacts frictionally engage one another, and thus require a certain amount of force to be connected. As the number of contacts increases in a given cross-sectional area, the force needed to join the header and plug increases. In addition, the overall size of connector assemblies continues to be reduced. Consequently, it has become more difficult to fully join headers and plugs given the increased engaging forces that must be applied to smaller and smaller components.

A need exists for a self-contained connector assembly offering a user assistance in moving the header and plug to the final engaged position even when substantial mating forces may be needed while retaining the features afforded by a CPA.

BRIEF SUMMARY OF THE INVENTION

A preferred embodiment of the present invention is provided with an electrical connector housing assembly comprising a connector housing, a header, a latch assist member and a connector position assurance device (CPA). The connector housing includes an outer enclosure and a mating opening. The header includes a mating portion that engages the mating opening on the connector housing. The latch assist member is mounted to one of the header and the connector housing and is moveable between open and closed positions relative to the outer enclosure. The latch assist member passage ways receive slide assist members on the other of the header and connector. The passage ways and slide assist members cooperate to forcibly draw the header and connector into a fully mated position when the latch assist member moves to the closed position relative to the outer enclosure. The CPA is slidably mounted to one of the connector and header and is moveable between locked and unlocked positions. The CPA secures the latch assist member in its closed position when the CPA is moved to its locked position.

In accordance with at least one alternative embodiment, the latch assist member includes upper and lower beams connected to one another through a cross bar located proximate one end of the upper and lower beams. The upper and lower beams slidably engage the connector and header. The latch assist member may optionally include one arm containing a slot cut therein. The header may include at least one post on a parameter thereof. The slot may receive the post when the header is inserted into the connector.

In accordance with at least one alternative embodiment, the latch assist member includes a channel formed in an interior surface of one side thereof. The channel extends backward from a leading edge of the latch assist member at an acute angle to a front edge of the latch assist member. The header may include a slide mating member received in the channel and drawn rearward by the slide mate assist connector during the mating operation. The latch assist member may include means for engaging the header and means for pulling the header into the connector housing. Optionally, the latch assist member may include a pair of slide arms extending parallel to one another, at least one of which includes a latch beam projecting outward from a periphery of the slide arm. The latch beam engages the connector to hold the latch assist member open until the connector and header are moved to a pre-mated position. Optionally, the latch assist member may include a latch beam engaging a projection on the connector to prevent the latch assist member from prematurely closing. The header may include a boss member projecting outward therefrom and aligned to contact and deflect the latch beam in order to disengage the latch beam from the projection.

In accordance with at least one alternative embodiment, the connector may include a slide retention projection engaging the latch assist member to hold the latch assist member in a pre-mated position on the connector. In accordance with at least one alternative embodiment, a method is provided for electrically connecting a plug and header through use of a lever assist member. The plug and header have contact mating faces that move in a direction orthogonal to the contact mating faces until abutting against one another when the plug and header are moved to a fully mated position. According to the method, the lever assist member is located in a pre-staged position with respect to the plug. The plug and header are then inserted into one another to an initial pre-mated position. When the plug and header are inserted to the pre-mated position, drive elements on the header and lever assist member are aligned with one another. The lever assist member is then pushed from the pre-stated position to a final closed position such that the drive elements draw the contact mating faces into abutment with one another when the lever assist lever moves to the final closed position.

In accordance with at least one alternative embodiment, once the lever assist member is moved to the final closed position, a connector position assurance device (CPA) is moved to the closed position. During the pushing step the lever assist member is moved in a direction substantially parallel to the contact mating faces. Optionally, during the pushing step, the lever assist member is moved in a direction other than the direction orthogonal to the contact mating faces in order to cause the drive elements to pull the plug and header toward one another along the orthogonal position. As a further alternative, a blocking step may be performed during the method, whereby movement of the lever assist member is blocked to prevent movement from the pre-staged position until the header and plug are inserted into the initial pre-mated position. Optionally, the method may include locking the lever assist member in the pre-staged position and unlocking the lever assist member when the plug and header are initially joined. Alternatively, the CPA may be blocked in the preset position until the header and connector are fully mated. Movement of the CPA from the preset position may be blocked by adding a feature on the header that engages the CPA until the header and connector are fully mated. Alternatively, the CPA may be blocked in the preset position by the slide which prevents the CPA from moving to the locked position until the slide is fully closed.

BRIEF DESCRIPTION OF THE DRAWINGS

The foregoing summary, as well as the following detailed description of the preferred embodiments of the invention, will be better understood when read in conjunction with the appended drawings. For the purpose of illustrating the present invention, there is shown in the drawings, embodiments that are presently preferred. It should be understood, however, that the present invention is not limited to the precise arrangements and instrumentality shown in the attached drawings.

DETAILED DESCRIPTION OF THE INVENTION

Figure 1:
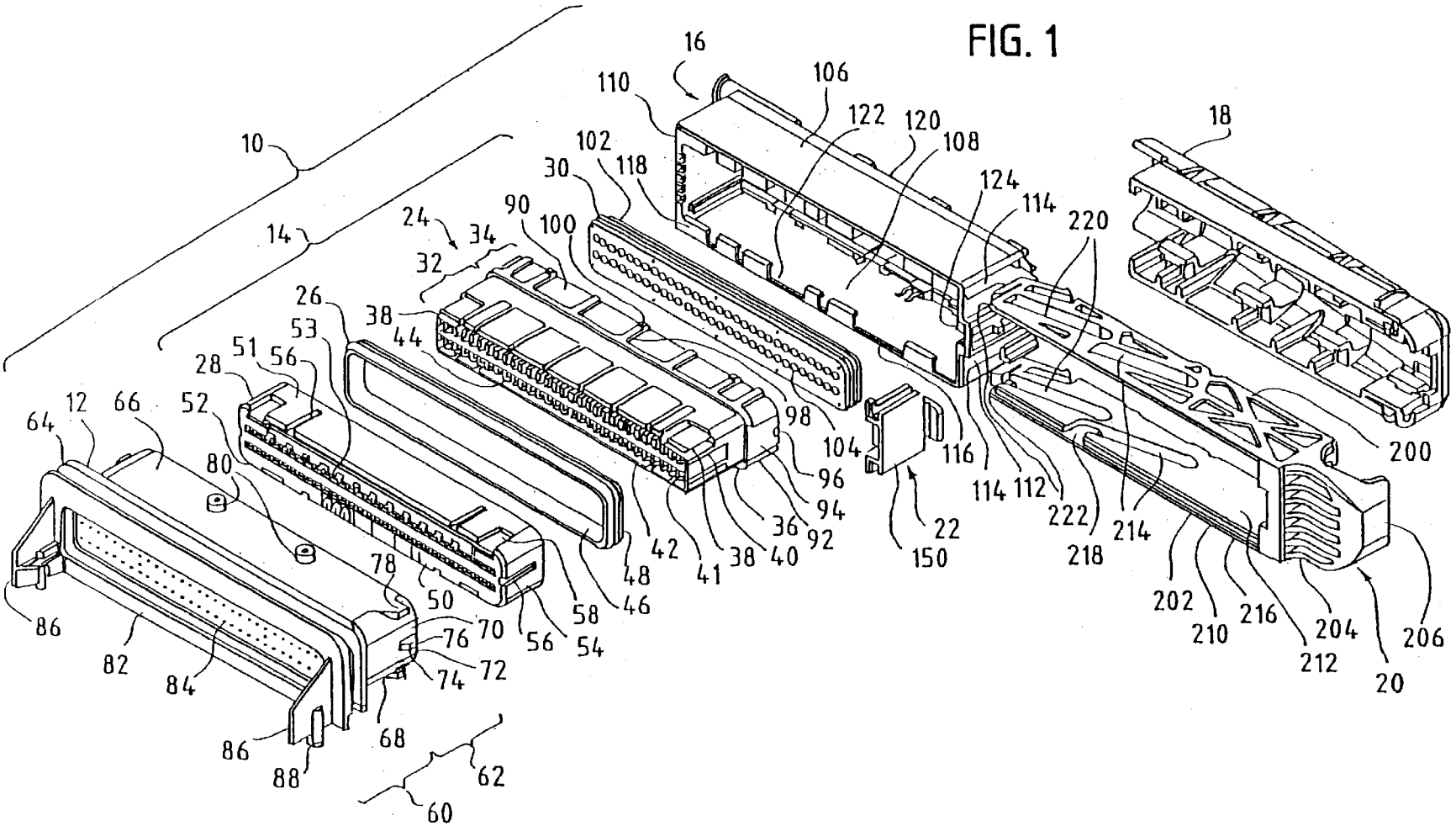
FIG. 1 illustrates and exploded view of a connector assembly formed in accordance with a preferred embodiment of the present invention.

FIG. 1 illustrates an exploded view of a connector assembly 10. The connector assembly 10 includes a header 12, a plug assembly 14, a cover 16, a wire shield 18, a sliding latch 20 and a connector position assurance device (CPA) 22. The plug assembly 14 includes a plug housing 24, a peripheral seal 26, a terminal position assurance device (TPA) 28, and a or wire seal 30. The plug housing 24 is divided into front and rear portions 32 and 34, respectively, with a dividing ledge 36 formed therebetween and extending about a perimeter of the plug housing 24. The dividing ledge 36 receives and frictionally retains the peripheral seal 26. The front portion 32 of the plug housing 24 includes notched regions 38 located on opposite ends thereof. Each notched region 38 includes a latching beam 40 having one end formed integral with the plug housing 24 and the opposite end extending toward a front face 42 of the plug housing 24. Each latching beam 40 includes a lateral rib 41 extending along the outer end thereof. The latching beams 40 are deflectable toward the base of the notched regions 38. The front face 42 includes a cavity that holds a matrix of female contact terminals 44. The contact terminals 44, in the example of FIG. 1, are aligned in two rows, with each row including 30 connector terminals 44.

The peripheral seal 26 includes a smooth inner surface 46 and a ribbed outer surface 48. The TPA 28 includes a front face 50, top and bottom surfaces 51 and 52, and end walls 54. The front face 50 includes a plurality of contact channels 53 aligned in a matrix. At least one of the top and bottom surfaces 51 and 52, and/or the end walls 54 include notches 56 extending from the front face 50 in a direction substantially perpendicular to the front face 50. In the example of FIG. 1, the TPA top surface 51 includes two rectangular cutouts 58. The notches 56 and cutouts 58 cooperate with corresponding features located on the interior of the header 12 to ensure proper alignment and functional coordination between the TPA 28 and header 12.

The header 12 is divided into front and rear portions 60 and 62, respectively, divided by a peripheral plate 64. The header rear portion 62 includes top and bottom surfaces 66 and 68 and end walls 70. The end walls 70 include projections 72 having ramped front and rear surfaces 74 and 76, respectively. The end walls 70 further include two knuckles 78 that function to ensure proper orientation of the header 12 in the cover 16. The top surface 66 includes at least one boss 80 extending upward therefrom. Optionally, the bottom surface 68 may also include one or more bosses 80. As explained below in more detail, the bosses 80 are actively engaged by the sliding latch 20 to draw the header 12 and plug housing 24 into firm engagement with one another thereby overcoming any mating forces created between the contacts and contact receptacles and sealing forces (if present). The header 12 includes a header front face 82 having a matrix of pin openings 84 therein. A pair of brackets 86 are mounted to the front face 82. The brackets 86 include pins 88 extending downward therefrom for engagement with a connector support structure (not shown). A pin organize may be located between brackets 86 to hold pins (not shown).

The rear portion 34 of the plug housing 24 includes top and bottom surfaces 90 and 92, respectively, and end walls 94. Both end walls 94 include a projection 96 are latches to secure the plug housing 24 to the cover 16. The top surface 90 include a plurality of ribs 98 having latching ramps 100 formed on the rear ends thereof. The latching ramps 100 securely retain the cover 16 to the plug assembly 14. The ribs 98 ensure proper orientation of the cover 16. The rear portion 34 of the plug housing 24 includes a cavity that sealably receives the mating seal 30. The outer perimeter of the mating seal 30 includes peripheral ribs 102 that form a seal with the interior of the rear portion 34. The mating seal 30 includes a matrix of contact openings 104 therein. The contact openings 104, contact terminals 44, contact channels 53, and pin openings 84 align with one another and cooperate to securely retain contacts and terminals therein.

The cover 16 includes top and bottom walls 106 and 108, respectively, and end walls 110 and 112. The end wall 112 include slots 114 that receive the sliding latch 20. A front edge 116 of the cover 16 includes a plurality of flanges 118 formed thereon. The flanges 118 extend upward from the front edge 116 of the bottom wall 108, and downward from the front edge 116 of the top wall 106. The flanges 118 are also formed along the rear edge 120 of the cover 16. The flanges 118 on the front and rear edges 116 and 120 define upper and lower channels that receive the sliding latch 20. The flanges 118 are spaced from one another to define notches 122 therebetween. The notches 122 have different shapes and some are aligned to receive corresponding features. The end wall 112 of the cover 16 includes a CPA retention assembly 124 located between the slots 114.

Figure 2:
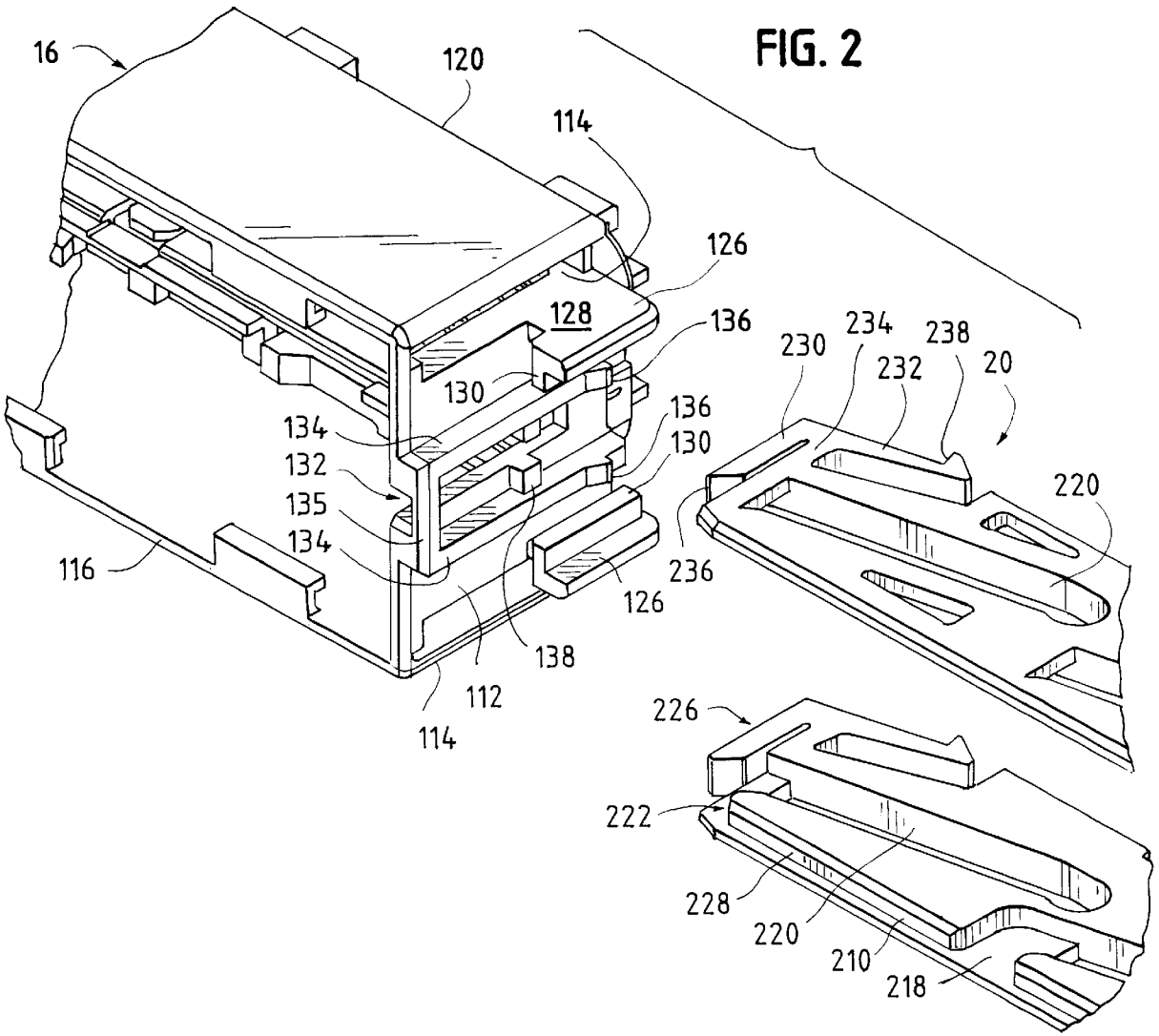
FIG. 2 illustrates an isometric view of a cover formed in accordance with a preferred embodiment of the present invention.

As shown more clearly in FIG. 2, the end wall 112 includes brackets 126 formed thereon proximate the slots 114. The brackets 126 include outer surfaces 128 that are aligned with the slots 114 to assist in alignment of the sliding latch 20 with the cover 16. The brackets 126 include inwardly extending beams 130 that are slidably received by the CPA 22. The beams 130 only extend approximately half-way inward from the rear edge 120 of the cover 16 to the center of the end wall 112. The beams 130 retain the CPA 22 while in its initial pre-staged position. The end wall 112 includes a notch 132 centered therein and extending rearward from the front edge 116. The notch 132 receives the projections 72 on the header 12 which disengages the CPA 22 and allows it to move from the preset to the final position to lock the slide 20 closed thus keeping the connections mated. Ribs 134 are formed along either side of the notch 132 and aligned to extend in the same direction as notch 132. The ribs 134 are connected by a cross bar 135 and include projections 136 on the outer surface thereof and located near the rear ends of the ribs 134. The projections 136 engage a CPA 22 to prevent disengagement of the CPA 22 from the cover 16. An additional projection 138 is formed on the end wall 112 immediately adjacent the notch 132. The projection 138 is located forward of the projections 136 at an intermediate point along the end wall 112. The projection 138 engages the CPA 22 when the CPA 22 is moved to its final engaged position (at which the header 12 and plug housing 24 are fully engaged with one another). Once the CPA 22 is moved to the forward location, the projection 138 retains the CPA 22 in a fully engaged position. The projection 138 also engages a surface 171 on the CPA 22 (FIG. 3) to hold the CPA 22 in the preset position. The latching projection 172 is deflected by the projection 72 on the header 12, thereby moving the surface 171 above the projection 138 and allowing the CPA 22 to be moved to the final position that locks the sliding latch 20 closed.

Figure 3:
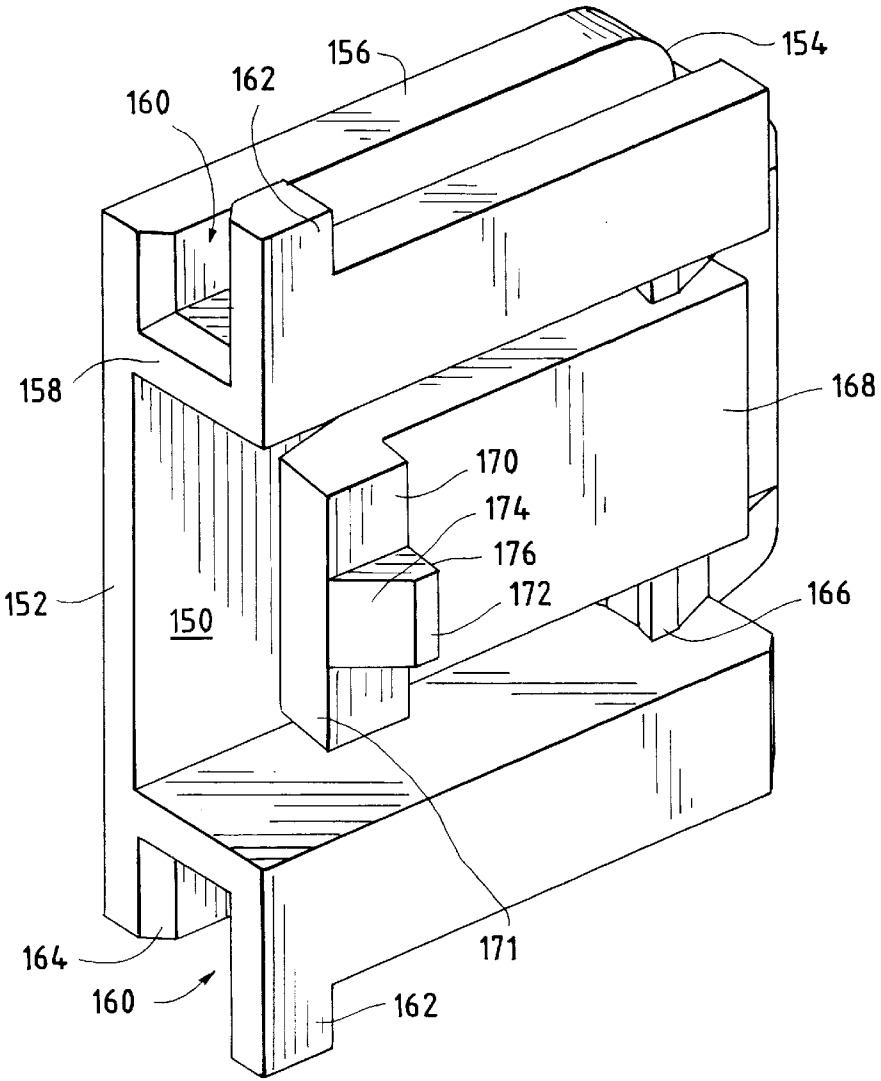
FIG. 3 illustrates an isometric view of a connector position assurance device formed in accordance with a preferred embodiment of the present invention.

As shown in FIG. 3, the CPA 22 includes a base 150 with front and rear ends 152 and 154, and sides 156. The CPA 22 includes L-shaped channels 158 formed along both sides 156 and extending between the front and rear ends 152 and 154. The channels 158 define key ways 160 that slidably receive the beams 130 formed on brackets 126. The channels 158 include pins 162 located near the front ends 152. The pins 162 engage the sliding latch 20 when in the fully locked position. The pins 162 prevent the CPA 22 from being disengaged from the cover 16, thereby functioning in a manner similar to projections 136, except in the opposite direction. The front ends 152 of the base 150 and channels 158 include beveled surfaces 164 to facilitate alignment to beams 221 (FIG. 4) on the sliding latch 20, as the CPA 22 is pushed from preset to a final position to lock the sliding latch 20 in place. When the guideway 160 straddle beams 130 and 221, the CPA is in the final position and the slide is locked closed. The CPA 22 further includes projections166 formed proximate, and extending along, the rear end 154 that work with projections 136. A CPA latch arm 168 includes one end that is formed on the cross beam 166 and is deflectable toward and to away from the base 150. An opposite end of the latch arm 168 includes a lateral ridge 170 and a latching projection 172 formed thereon. The latching projection 172 includes a ramp surface 174.

The latching arm 168 cooperates with the projection 72 on the header 12 to ensure that the header 12 and plug housing 24 are fully engaged with one another before the CPA 22 may be moved to a final locking position. More specifically, the ramp surface 174 engages the ramp rear surface 76 on the projection 72 to bias the latching arm 168 toward the base 150 as the connectors are mated, allowing the CPA 22 to be moved to its final engaged position. Once the projection 172 rides over the projection 72, a latching surface 176 on the projection 170 engages a latching surface **138*b* (FIG. 2) located on the front surface of the projection 138**.

Figure 4:
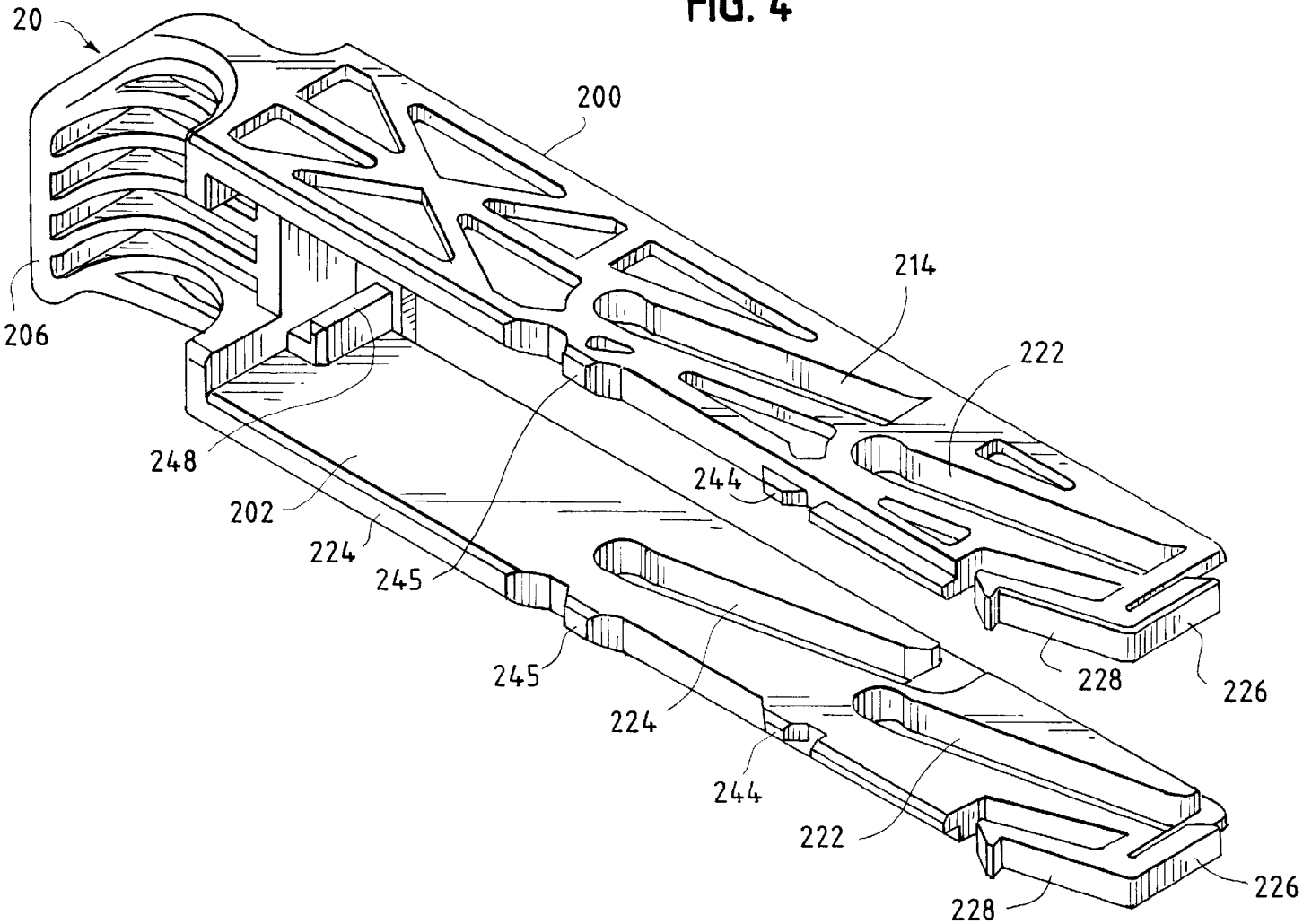
FIG. 4 illustrates an isometric view of a connector mating assist member formed in accordance with a preferred embodiment of the present invention.

As shown in FIGS. 1 and 4, the sliding latch 20 includes upper and lower beams 200 and 202 that are interconnected through a cross member 204. A handle 206 is formed with the cross member 204. The upper and lower beams 200 and 202 include cutouts 210 extending along a length of the front and rear edges thereof. The cutouts 210 are received within the channels formed by flanges 118 proximate the front edges 116 of the cover 16. The slots 114 operate such that if the sliding latch 20 is flipped over, it is prevented from being installed into the cover 16. The cutouts 210 are only received in the front channels 118. The upper and lower beams 200 and 202 include an inner surface 212 having a notch 214 therein that is aligned to extend from a front edge 216 of the lower beam 202 at an acute angle across the width of the lower beam 202. The notch 214 includes a front end forming a mouth 218 opening to and facing the front edge 216. The notch 214 extends through the lower beam 202 along the main body of the notch 214, but not at the mouth 218 to prevent degradation of the structural integrity. The mouth 218 receives a corresponding boss 80 during connection and guides the boss 80 along the main body of the notch 214. The boss 80, when moved from the mouth 218 into the main body of the notch 214, extends outward into the notch 214. Optionally, the upper and/or lower beam 200 and 202 may include a second notch 220 having one end forming a mouth 222.

Figure 5:
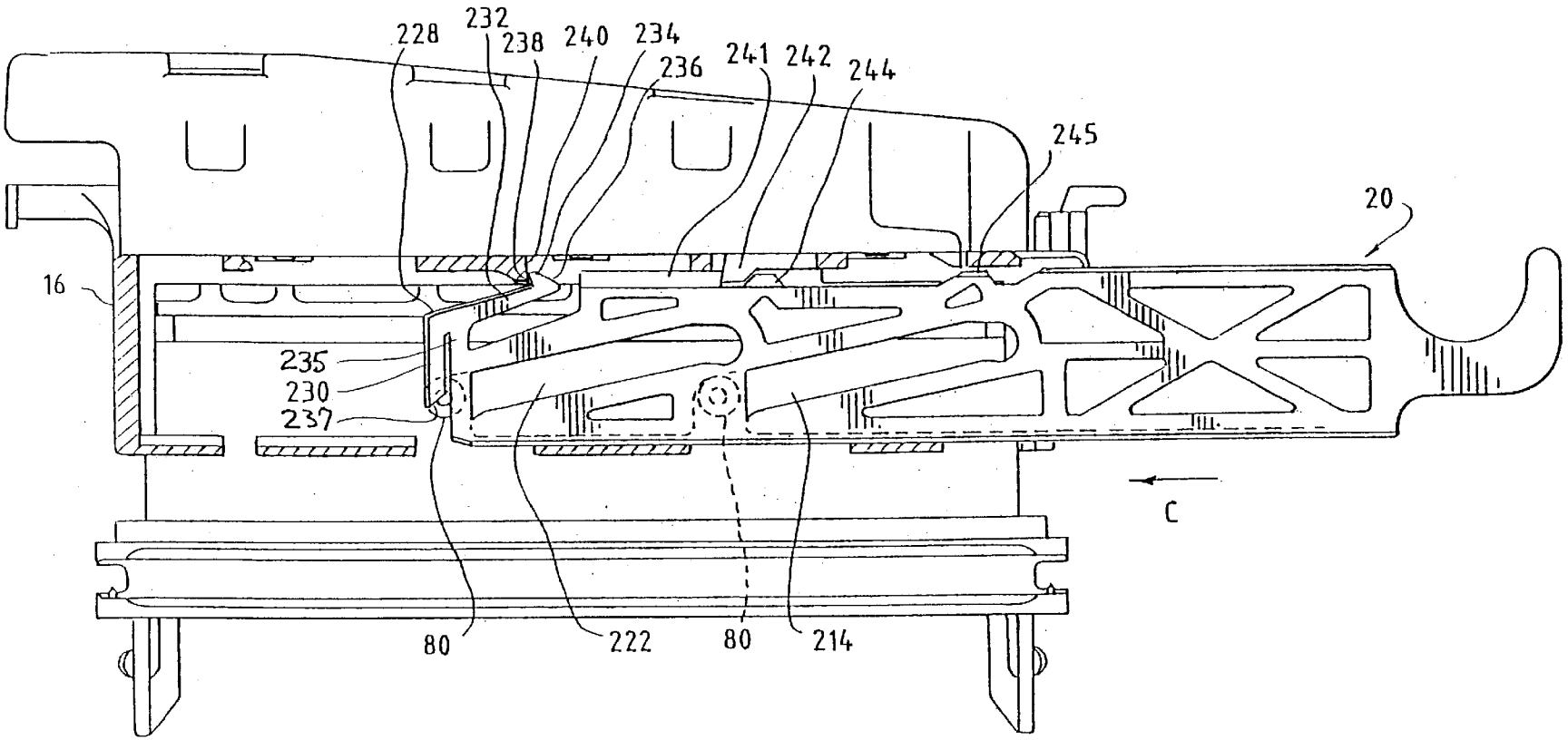
FIG. 5 illustrates the top plan view of the connector assembly while in a premated position in accordance with a preferred embodiment of the present invention.
Figure 6:
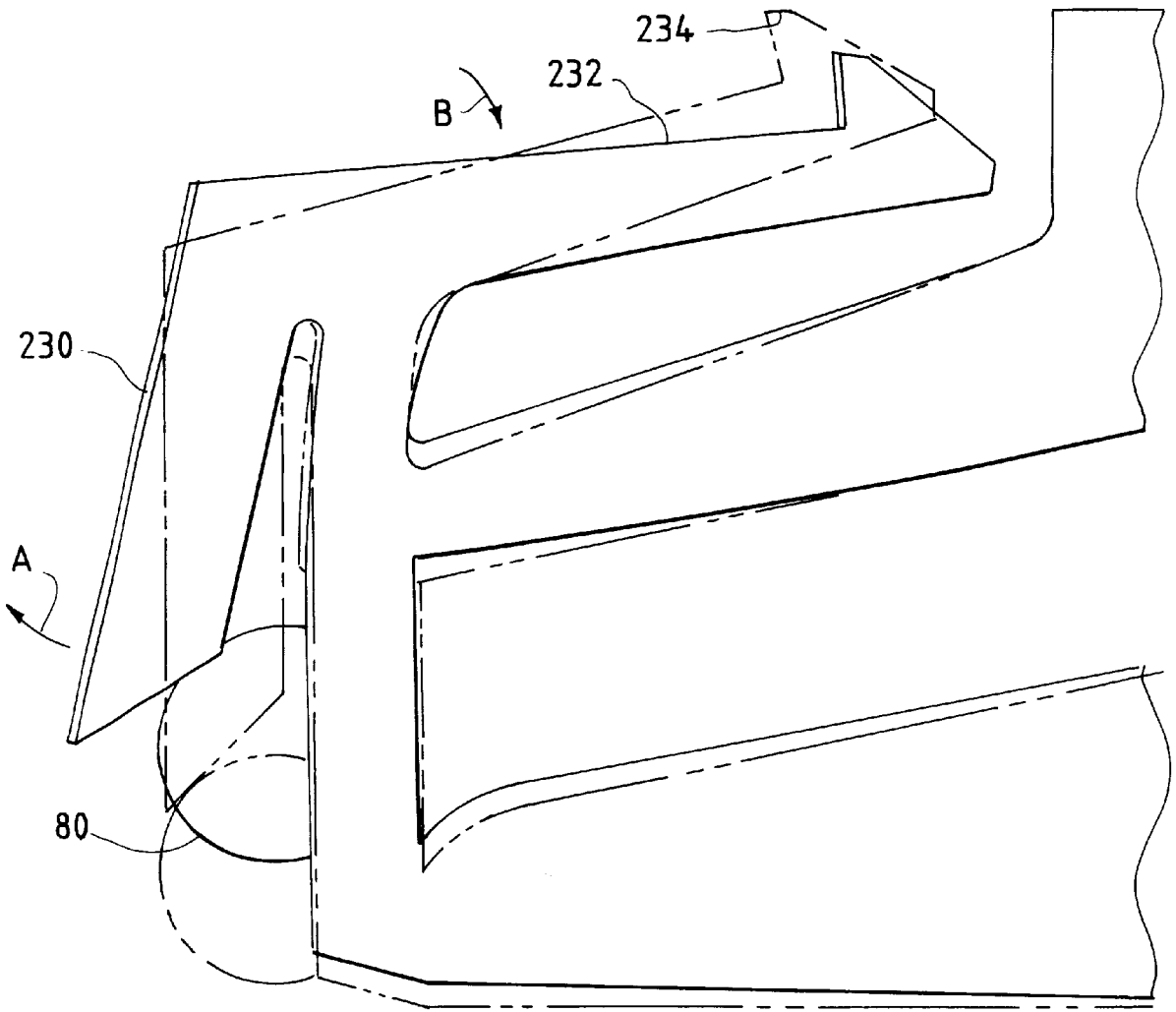
FIG. 6 illustrates an end portion of a connector mating assist member operating in accordance with a preferred embodiment of the present invention.

FIGS. 4–6 illustrate the sliding latch 20 in more detail. Rear edges 224 of the upper and lower beams 200 and 202 do not include cutouts, such as cutouts 210 along the front edges 216. Outer ends 226 of the upper and lower beams 200 and 202 include cantilevered latches 228. Optionally only one latch 228 need be used.

As shown in FIG. 5, the cantilevered latch 228 includes an action beam 230 formed with a latch beam 232. The cantilevered latches 228 are formed integrally with a pivot post 235 on the outer ends 226 of the upper and lower beams 200 and 202. The upper end of the latch beam 232 includes a latching projection 234 with a ramp forward surface 236 and a catch surface 238. The lower end of the action beam 230 includes a beveled surface 237 that engages a boss 80 when the header 12 is initially engaged with the connector assembly 10.

As shown in FIG. 5, the cover 16 includes a latching member 240 mounted on rear wall 120 and aligned to engage the latch beam 232. When the boss 80 is moved from a first engagement position (as denoted by the boss 80 shown in a dashed line in FIG. 6) to a premated position (as denoted by the boss 80 shown in a solid line in FIG. 6), the boss 80 biases of the action beam 230 outward in a direction denoted by arrow A. As the action beam 230 is driven outward, the latch beam 232 is cantilevered downward in the direction of arrow B until the latching projection 234 clears the latching member 240. The latching projection 234 and latching member 240 cooperate such that the sliding latch 20 is not permitted to be completely engaged until the header 12 and plug assembly 10 are joined in a premated position.

The cover 16 further includes an embossment 242 aligned with the front or rear edge of one of the upper and lower beams 200 and 202. At least one edge of the upper or the lower beam 200 and 202 includes a projection 241 formed thereon and aligned with embossment 242. The embossment 242 and projection 241 engage one another. Optionally, projection 244 may be included, but is not necessary if catch surface 238 is used. Once the projection 241 is moved forward past the embossment 242, they cooperate to prevent the sliding latch 20 from being entirely removed from the cover 16. Projection 245 engages embossment 242 to assist in holding latching slide 20 in the fully closed position.

When the header 12 is moved into the premated position with the plug housing 24, the bosses 80 are aligned to enter the mouths 218 and 222 of the notches 214 and 220, respectively. Once the bosses 80 enter the mouths 218 and 222, the sliding latch 20 may be moved in the direction of arrow C. As the latch 20 is closed in the direction of arrow C, the bosses 80 are forced along the notches 214 and 220. The notches 214 and 220 force the bosses 80 forward relative to the plug housing (i.e., in a direction orthogonal to the contact mating faces of the plug housing 24 and header 12), thereby drawing the header 12 into a fully engaged position with the plug housing 24.

Figure 8:
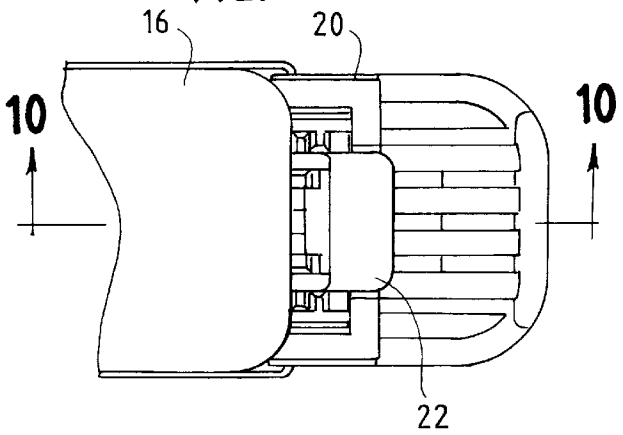
FIG. 8 illustrates a cover, CPA and connector mating assist member located in a fully engaged position formed in accordance with a preferred embodiment of the present invention
Figure 10:
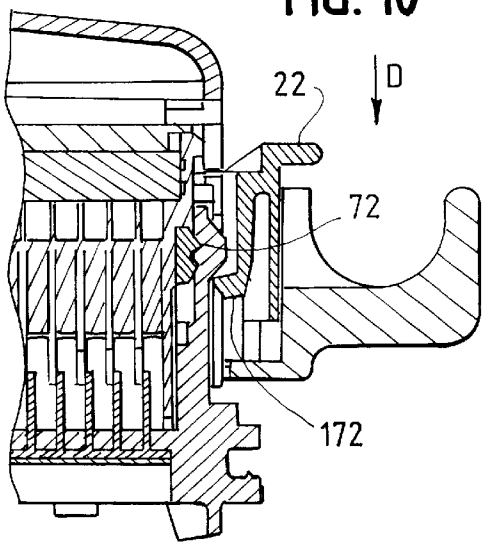
FIG. 10 illustrates a cross-sectional view taken along line 10—10 in FIG. 8 in accordance with a preferred embodiment of the present invention.
Figure 7:
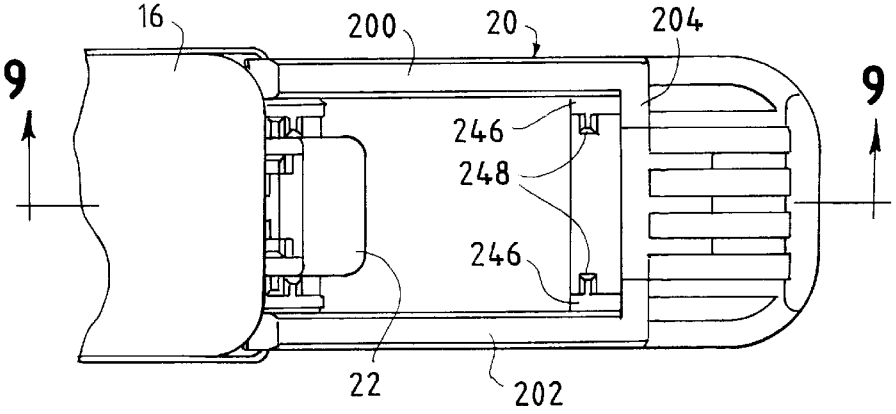
FIG. 7 illustrates a top plan view of a cover, CPA and connector mating assist member located in a pre-mated position in accordance with a preferred embodiment the present invention.
Figure 9:
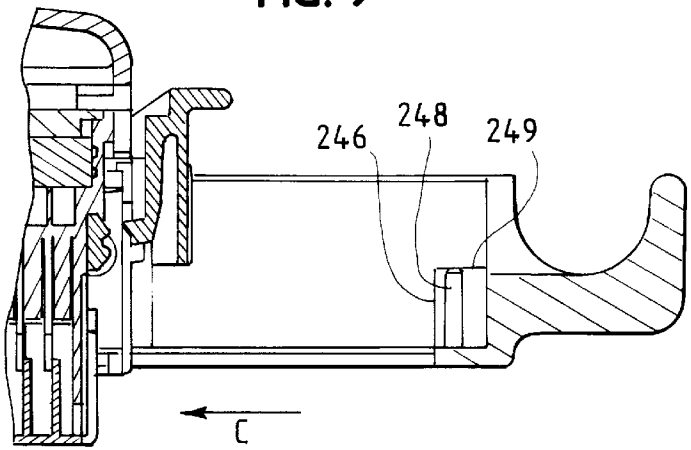
FIG. 9 illustrates a cross-sectional view taken along line 9—9 in FIG. 7 in accordance with a preferred embodiment of the present invention.
Figure 11:
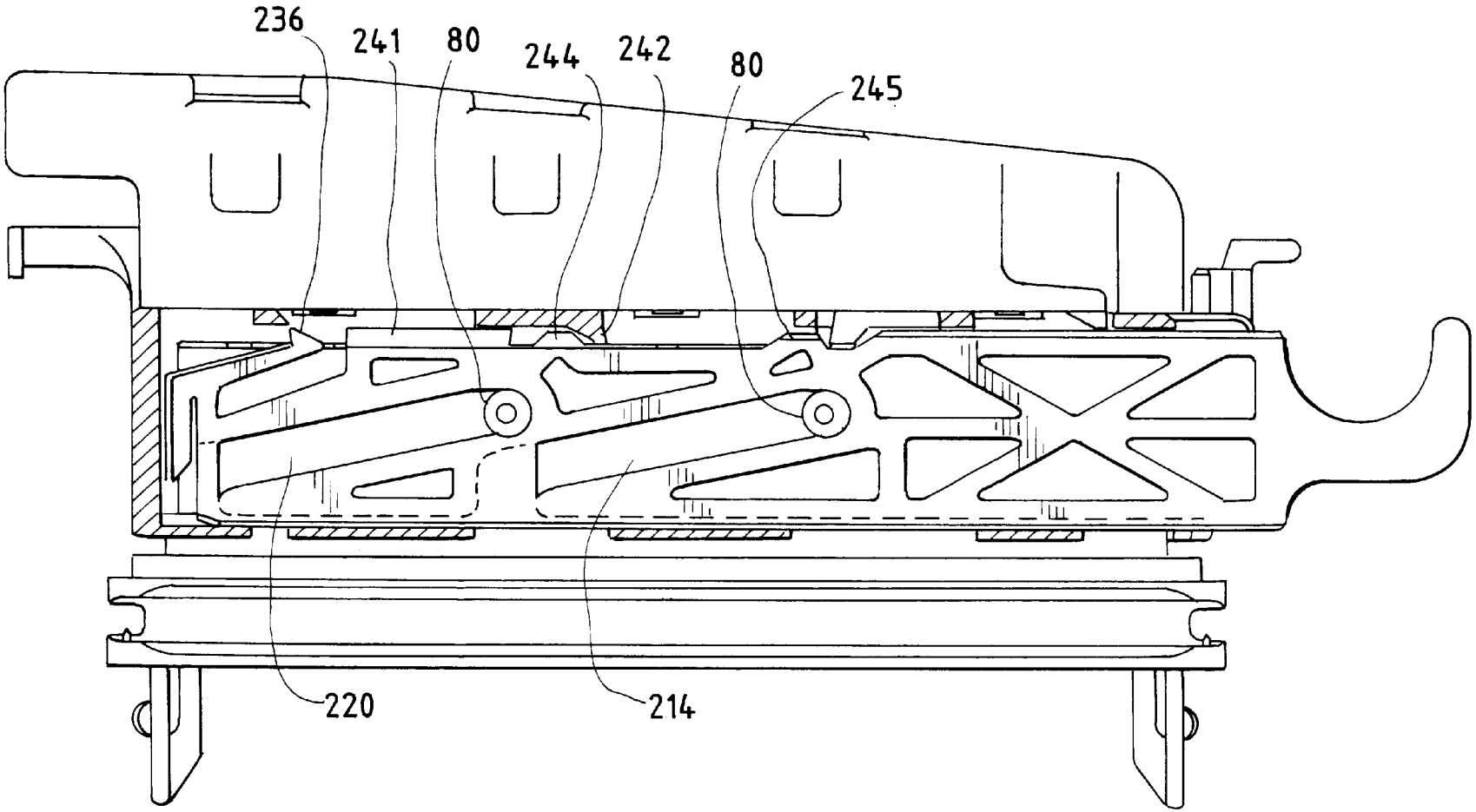
FIG. 11 illustrates a top plan view of a connector assembly formed in accordance with a preferred embodiment of the present invention with the connector mate assist member in the fully engaged position.

FIGS. 7–10 illustrate the operation of the sliding latch 20 in cooperation with the cover 16. FIGS. 7 and 9 illustrate the sliding latch 20 while in an initial premated position, while FIGS. 8 and 10 illustrate the sliding latch 20 when in a fully engaged position. FIGS. 9 and 10 illustrate cross-sectional views taken along lines 9—9 in FIG. 7 and 10—10 in FIG. 8. As shown in FIG. 7, the cross member 204 on the sliding latch 20 includes a pair of vertical beams 246 with vertical keys 248 formed thereon. The vertical keys 248 face one another. The beams 246 and vertical keys 248 block premature insertion of the CPA 22. The beams 246 and vertical keys 248 extend upward from the lower beam 202 to an intermediate height along the cross member 204 (FIG. 9). The top edge 249 of the keys 248 are dimensioned to fit below, and align with the beams 130 formed on brackets 126. The vertical keys 248 are aligned with guide ways 160 once the sliding latch 20 is moved in the direction of arrow C to the fully engaged position. The vertical keys 248 contact the front end 152 of the CPA 22 until the sliding latch 20 is moved to the fully engaged position, at which time the CPA 22 is movable in the direction of arrow D (FIG. 10) to the fully engaged position. As the CPA 22 is moved to the fully engaged position, the projection 172 travels over the projection 72 on the end wall 70 of the header 12.

The foregoing structure operates in the opposite manner when disconnecting the header 12 and plug assembly 14. In particular, the sliding latch 20, when pulled outward, forces the header 12 and plug assembly 14 apart. Before the sliding latch 20 is movable, the CPA 22 must first be disengaged to allow the connector assembly to be unmated.

While the preferred embodiments illustrate the sliding latch 20 as being connectable to a cover 16, the present invention is not limited to any such implementation. Optionally, the sliding latch 20 may be configured to directly engage one of the cover 12 and plug housing 24. For example, the top and bottom surfaces of the plug housing 24 may be formed with at least one channel therein extending along the length of the rear portion 34 of the plug housing 24, while the interior surfaces of the upper and lower beams 200 and 202 may be formed with parallel keys facing one another and extending along the beams 200 and 202. The keys ride in the channels.

Alternatively, the sliding latch 20 may be slidably mounted to the header 12, while the bosses 80 are formed on the plug housing 24. In the alternative configuration, the sliding latch 20 is mounted in a premated position on the cover 12, and arranged to accept bosses 80 located on the plug housing 24. Once the bosses 80 on the plug housing 24 are received within the sliding latch 20, the sliding latch 20 may be closed to facilitate engagement. As a further alternative, the CPA 22 may be formed on either of the cover 12 and plug housing 24.

The embodiment illustrated in FIG. 1 shows the sliding latch 20 to be mounted from one side of the cover 16. However, the present invention is not limited to any such implementation. For example, the sliding latch 20 may be mounted to the opposite side of the cover 16, or to either side of the header 12 or plug housing 24. As a further alternative, the sliding latch 20 may be mounted to the top or bottom of the cover 16, plug housing 24 or header 12.

The embodiment illustrated in FIG. 1, uses multiple notches 214 and 220 on the upper and lower beams 200 and 202. However, the present invention is not limited to any such implementation. Instead, a single notch may be used on both beams or only on one beam. Alternatively, more than two notches may be used on each beam or on either beam. As a further alternative, the notches 214 and 222 may be formed on either of the header 12 and plug housing 24, while the bosses 80 may be formed on the sliding latch 20. Optionally, features other than notches and bosses may be used to engage the sliding latch 20 and cover 12.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector housing assembly comprising:

a connector having an outer enclosure surface and a mating opening;

a header having a mating portion to engage said mating opening;

a latch assist member mounted to one of said header and said connector and movable between open and closed positions relative to said outer enclosure surface and having passageways receiving slide assist members on the other of said header and connector, said passageways and slide assist members cooperating to forcibly draw said header and connector into a fully mated position when said latch assist member moves to the closed position relative to said outer enclosure surface, said latch assist member and connector engaging each other to hold said latch assist member open until said connector and header are pre-mated; and a connector position assurance device (CPA) slidably mounted to one of said connector and header and moveable between locked and unlocked positions, said CPA securing said latch assist member in said closed position when said CPA is moved to said locked position.

2. The electrical connector housing assembly of claim 1, wherein said latch assist member includes upper and lower beams connected to one another through a cross bar located proximate one end of said upper and lower beams, said upper and lower beams slidably engaging said connector and header.

3. The electrical connector housing assembly of claim 1, wherein said latch assist member includes at least one arm containing a slot cut therein, said header including at least one post on a perimeter of said header, said slot receiving said post when said header is inserted into said connector.

4. The electrical connector housing assembly of claim 1, wherein said latch assist member includes a channel formed in an interior surface of one side thereof, said channel extending backward from a leading edge of said latch assist member at an acute angle, said header including a slide mating member received in said channel, and drawn rearward by, said latch assist member during a mating operation.

5. The electrical connector housing assembly of claim 1, wherein said latch assist member includes means for engaging said header and means for pulling said header into said connector housing.

6. The electrical connector housing assembly of claim 1, wherein said latch assist member includes a pair of slide arms extending parallel to one another, at least one of said slide arms including a latch beam projecting outward from a periphery of said slide arm, said latch beam engaging said connector to hold said latch assist member open until said connector and header are pre-mated.

7. The electrical connector housing assembly of claim 1, wherein said latch assist member includes a latch beam engaging a projection on said connector to prevent said latch assist member from prematurely closing, said header including a boss member projecting outward therefrom and aligned to contact and deflect said latch beam in order to disengage said latch beam from said projection.

8. The electrical connector housing assembly of claim 1, said connector including a slide retention projection engaging said latch assist member to hold said latch assist member in a premated position on said connector.

9. The electrical connector housing assembly of claim 1, wherein said CPA is slidably mounted between said latch assist member and connector housing.

10. The electrical connector housing assembly of claim 1, further comprising a cover mounted over said connector housing, said cover including one end with slots therein, said slots receiving said latch assist member.

11. The electrical connector housing assembly of claim 1, further comprising a cover mounted over said connector housing, said cover having guide rails mounted on at least one side thereof, said guide rails slidably directing said CPA along a first direction with respect to said cover, said cover having slide channels mounted on at least one other side thereof, said slide channels slidably directing said latch assist member along a second direction with respect to said cover.

12. An electrical connector housing assembly, comprising:

a plug having a contact mating portion and a base portion;

a header having an exterior shell defining a contact mating receptacle that receives said contact mating portion of said plug;

a first drive member on one of said plug and header;

a lever arm movably affixed to one of said plug and header, said lever arm being moveable relative to said plug and header between an initial premated position and a final fully engaged position, said lever arm including a second drive member engaging said first drive member when said plug and header are joined in said initial premated position, when said lever arm is moved from said premated position to said fully engaged position, said first and second drive members operating on one another, to draw said contact mating receptacle and contact mating portion together into a fully mated position, said lever arm and said one of said plug and header engaging each other to hold said lever arm open until said plug and header are pre-mated; and a CPA mounted to one of said plug and header.

13. The electrical connector housing assembly of claim 12, wherein said CPA includes a latch beam and one of said plug and header include a CPA latch projection, said latch beam snappably engaging said CPA latch projection only when said plug and header are in said fully mated position.

14. The electrical connector housing assembly of claim 12, wherein said CPA includes a key and said lever arm includes a key way, said lever arm blocking closure of said CPA until said lever arm is moved to said fully engaged position at which said key and key way align with one another, thereby permitting said CPA to close.

15. The electrical connector housing assembly of claim 12, wherein said lever arm includes at least one beam slidably mounted to a plug assembly including said plug, said beam having said second drive member thereon, said second drive member being located near a side edge of said beam and extending across a width of said beam, said second drive member pulling said first drive member across said width of said beam as said beam is slid along its length with respect to said plug and header.

16. The electrical connector housing assembly of claim 12, wherein said second drive member includes at least one slot in said beam and said first drive member includes at least one boss, said slot having an open mouth at one end to accept said boss.

17. The electrical connector housing assembly of claim 12, further including a cover retaining said plug therein, said cover including slots in one end thereof to accept said lever arm, said cover including flanges along at least one edge defining a channel within which said lever arm slides.

18. The electrical connector housing assembly of claim 12, further including a cover retaining said plug therein, said cover including slots in one end thereof to accept said lever arm, said cover including a CPA retention assembly on said end having said slots.

19. The electrical connector housing assembly of claim 12, wherein said lever arm includes parallel beams sliding along top and bottom surfaces of said plug and header, said CPA being mounted to an end of said plug and header and positioned between said parallel beams.

20. The electrical connector housing assembly of claim 12, wherein said lever arm includes a cantilevered latch on an outer end thereof and said plug includes an embossment aligning with said cantilevered latch to prevent premature closure of said lever arm.

21. An electrical connector housing assembly comprising:

a connector having an outer enclosure surface and a mating opening;

a header having a mating portion to engage said mating opening;

a latch assist member mounted to one of said header and said connector and movable between open and closed positions relative to said outer enclosure surface and having passageways receiving slide assist members on the other of said header and connector, said passageways and slide assist members cooperating to forcibly draw said header and connector into a fully mated position when said latch assist member moves to the closed position relative to said outer enclosure surface; and a connector position assurance device (CPA) slidably mounted to one of said connector and header and moveable between locked and unlocked positions, said CPA securing said latch assist member in said closed position when said CPA is moved to said locked position, said CPA being slidably mounted between said latch assist member and connector housing.

22. An electrical connector housing assembly comprising:

a connector having an outer enclosure surface and a mating opening;

a header having a mating portion to engage said mating opening;

a latch assist member mounted to one of said header and said connector and movable between open and closed positions relative to said outer enclosure surface and having passageways receiving slide assist members on the other of said header and connector, said passageways and slide assist members cooperating to forcibly draw said header and connector into a fully mated position when said latch assist member moves to the closed position relative to said outer enclosure surface;

a connector position assurance device (CPA) slidably mounted to one of said connector and header and moveable between locked and unlocked positions, said CPA securing said latch assist member in said closed position when said CPA is moved to said locked position; and a cover mounted over said connector housing, said cover having guide rails mounted on at least one side thereof, said guide rails slidably directing said CPA along a first direction with respect to said cover, said cover having slide channels mounted on at least one other side thereof, said slide channels slidably directing said latch assist member along a second direction with respect to said cover.

* * * * *